US008122575B2

(12) United States Patent
Kang

(10) Patent No.: US 8,122,575 B2
(45) Date of Patent: Feb. 28, 2012

(54) STRUCTURE FOR SUPPORTING CLOTHES TO BE DECOLORIZED, METHOD OF FORMING THE SAME AND METHOD OF USING THE SAME

(75) Inventor: Joo Sik Kang, Seoul (KR)

(73) Assignee: KOOS Manufacturing, Inc., South Gate, CA (US)

( * ) Notice: Subject to any disclaimer, the term of this patent is extended or adjusted under 35 U.S.C. 154(b) by 419 days.

(21) Appl. No.: 12/242,611

(22) Filed: Sep. 30, 2008

(65) Prior Publication Data

US 2009/0178258 A1 Jul. 16, 2009

(30) Foreign Application Priority Data

Jan. 10, 2007 (KR) ..... 10-2007-0098855

(51) Int. Cl.
*D06C 23/02* (2006.01)

(52) U.S. Cl. ..... 26/27; 26/28; 223/67; 223/72

(58) Field of Classification Search ..... 26/27, 28, 26/51, 80, 69 B, 69 C; 28/153, 165; 223/67, 223/120, 52, 57, 63, 72–74; 451/29, 178
See application file for complete search history.

(56) References Cited

U.S. PATENT DOCUMENTS

| | | | | |
|---|---|---|---|---|
| 3,550,820 | A * | 12/1970 | O'Boyle | 223/73 |
| 4,845,790 | A * | 7/1989 | Brasington | 8/150 |
| 5,395,281 | A * | 3/1995 | Tonello | 451/28 |
| 5,505,739 | A | 4/1996 | Montesano | |
| 5,567,207 | A | 10/1996 | Lockman et al. | |
| 5,593,072 | A | 1/1997 | Hester et al. | |
| 5,948,120 | A * | 9/1999 | Sights et al. | 8/114.5 |
| 6,090,158 | A * | 7/2000 | McLaughlin | 8/400 |
| 6,252,196 | B1 | 6/2001 | Costin et al. | |
| 6,974,366 | B1 | 12/2005 | Johnson | |
| 7,014,662 | B1 | 3/2006 | Mei et al. | |

FOREIGN PATENT DOCUMENTS

| | | | |
|---|---|---|---|
| EP | 417659 | A1 * | 3/1991 |
| EP | 0 616 066 | A1 | 9/1994 |
| GB | 2223037 | A * | 3/1990 |
| JP | 2002-155465 | A | 5/2002 |
| KR | 10-0626866 | B1 | 9/2006 |
| WO | WO 00/13805 | | 3/2000 |
| WO | WO 03/029545 | A1 | 4/2003 |

OTHER PUBLICATIONS

The International Search Report and the Written Opinion of the International Searching Authority, or the Declaration, dated Feb. 24, 2010, for International Application No. PCT/IB2008/004008, Filed Sep. 30, 2008.

Patent Abstracts of Japan and English machine translation of JP 2002-155465 listed above.

Korean Patent Abstracts and English machine translation of KR 10-0626866 listed above.

* cited by examiner

*Primary Examiner* — Amy Vanatta
(74) *Attorney, Agent, or Firm* — Christie, Parker & Hale, LLP

(57) ABSTRACT

This invention is about a structure for supporting clothes to be decolorized and for aiding in the process of decoloration, to a method of forming the same, and to a method of using the same to decolorize clothes. It includes manufacturing a semi-finished product for supporting clothes and manufacturing the supporting structure as well as a the method of decolorizing clothes using the supporting structure to have various decolorizing textures and styles.

11 Claims, 3 Drawing Sheets

STRUCTURE FOR SUPPORTING CLOTHES TO BE DECOLORIZED, METHOD OF FORMING THE SAME AND METHOD OF USING THE SAME

CROSS-REFERENCE TO RELATED APPLICATION(S)

This application claims the benefit of and priority to Korean Patent Application No. 10-2007-0098855, filed Oct. 1, 2007, the entire contents of which are incorporated herein by reference.

BACKGROUND OF THE INVENTION

This invention is about the structure for supporting clothes to be decolorized in part, i.e., to be decolorized in selected areas. The supporting structure with various textures on its surface can be produced by a molding process, and the cloth decoloration can be achieved easily by this supporting structure so that the production of decolorizing clothes is efficiency improved.

At ordinary times, consumers often feel their clothes are dull. In order to overcome this problem, it has now become popular that the original clothes are decolored in areas.

For instance, it is popular that the original jeans are changed into worn jeans. The jeans are decolored by being rubbed to avoid the normal color of the jean. Decoloration is achieved by placing the jeans over a supporting structure and then rubbing the jeans with a brush or by chemically treating the jeans.

The typical supporting structure to aid in the decolorization of the jeans is made by the following mode. A sheet with a little synthetic resin is formed in the shape of the jean, referred to herein as the semi-finished product. After then, part of formed jean shape is folded and sewn again to form a few of textures and to produce the supporting structure for jean shape.

But, we know by the above mode that the former manufacturing technology needs a lot of work to form a few of textures in jean shape. Such texture work is different greatly according to the skill and work attitude of employees. Moreover, the texture production by manual operation increases the work stress of employees.

In addition, the texture is formed by sewing work so the texture on the surface of jean to be decolorized is one single and humdrum line shape. This can't meet the demand of consumers for various textures.

SUMMARY OF THE INVENTION

This invention is made to settle the above problems. While the structure for supporting clothes to be decolorized for various textures is produced largely, the production process flow is simplified. It aims to provide and manufacture the structure for supporting clothes to be decolorized.

Another purpose of this invention is to provide the manufacturing method of structure for supporting clothes to be decolorized or rubbed for obtaining various textures on the surface of such clothes and to meet the different demands of consumers.

This invention has also another one purpose, that is the decoloration and abrasion process of various shapes for clothes surface to meet the demand of consumers.

DETAILED DESCRIPTION OF THE INVENTION

In order to achieve the above purpose, this invention includes manufacturing a semi-finished product for clothes from a sheet of flexible material and manufacturing a supporting structure after a pair of semi-finished products are combined. The semi-finished product adopts the shape of a mold with a concavo-convex texture. Silicon, rubber or Neoprene nylon can be selected as the sheet of flexible material.

According to the invention, the amount of labor required for decolorizing clothes is reduced as the conventional work step of texture formation in a semi-finished state is alleviated. Additionally, the supporting structure can be used to form certain textures according to a press process so that the clothes with decoloration in portion thereof can be processed largely. Various textures and styles also can be provided to meet the different demand of customers.

Through the following invention, the manufacturing method of a structure for supporting clothes to be decolorized is explained. In order to be explained easily, jeans are used by way of example for illustrative purposes. Here, the jean-shaped semi-finished product refers to a semi-finished product for clothes.

First, a mold corresponding to a jean-shape semi-finished product structure is fabricated. The surface of the structure or the mold is formed with a few of concavo-convex textures. Such textures are not limited to concavo-convex textures and they can, for example, be the pattern of animal, plant, building, or words and Arabic numerals or line shapes, etc.

Figure 3:
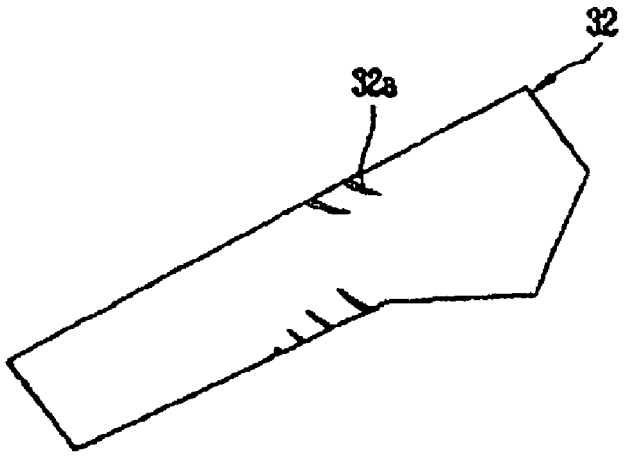
FIG. 3 is a sketch of are integrated-mode semi-finished product structure for supporting clothes to be decolorized according to this invention.

The semi-finished product of these jeans shape can include a leg part 12, 14 (FIG. 1), or the integrated mode of a waist and leg 32 (FIG. 3).

The mold can include a first mold part with textures on its surface and a second mold without texture on surface. The textures are defined by projections and depressions. The textured surface may have concave and convex portions in cross-sections.

The mold manufactured by the above process is installed on a Press device (not shown). The Press device includes an upper mold part and a lower mold part. The sheet of materials is processed between the upper mold past and the lower mold part into the cloth sheet with the formed-on textures according to the press movement which are coincidence with the upper and lower mold parts.

That is, according to this invention, a sheet of material is placed between the upper mold part and the lower mold part and processed to manufacture a leg-part-shape semi-finished product (12 or 14). The above motioned sheet of material may be made from balata, rubber, silicone or Neoprene nylon which is then used in a Press process. The textures on the first mold part surface are positioned so as to create a complementary texture on a surface of the pressed sheet of material. The pressed sheet of material is then used to form the semi finished product to have for example a pants leg shape. The pressed sheet of material may also be formed to have such shape by sewing or other methods.

Figure 1:
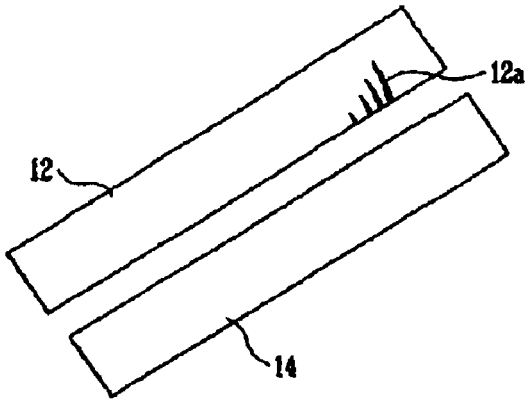
FIG. 1 is a sketch of trouser-mode semi-finished product structure for supporting clothes to be decolorized according to this invention.

By now, the above mentioned leg-part-shape semi-finished product has the texture of some shapes. E.g., when making decoloration with some textures on one side of the jean, as shown in FIG. 1, the leg-part shape can consist of the first semi-finished product (12) of quadrangle structure with some textures (12*a*); and the second semi-finished product (14) of quadrangle structures with or without some textures. The first semi-finished product (12) and the second semi-finished product (14) of such quadrangle structures are corresponding to the leg part of jeans.

Figure 2:
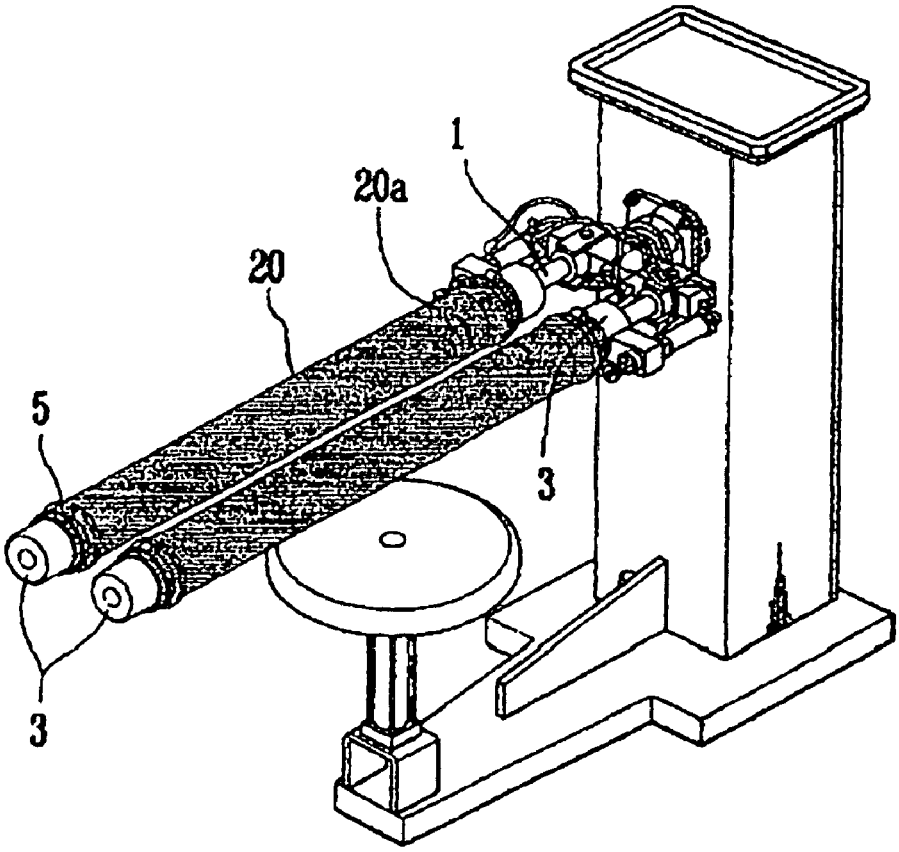
FIG. 2 is a sketch of the supporting structure for clothes decoloration installed in a jean decoloration device.

After that, one pair of semi-finished product among the semi-finished products of quadrangle leg-part structure formed according to the above mentioned Press is combined to manufacture the leg-part-shape supporting structure (20; FIG. 2) of this invention. The pair of semi-finished product (12, 14) of leg-part-shaped structure are placed opposite each other, and adhered to each other with glue or sewing along their length, or by using other methods. After completing, the certain textures are located on one side at least according to the leg-part-shaped supporting structure (20) of this invention.

Figure 4:
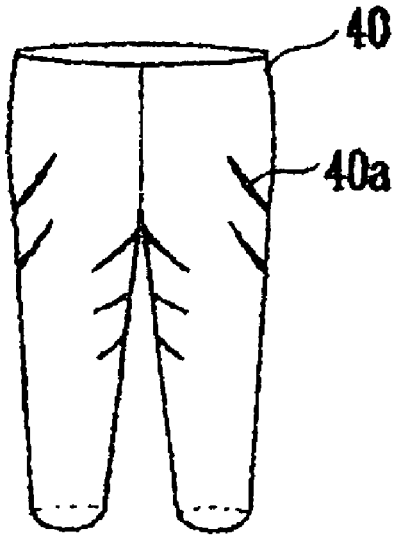
FIG. 4 is a sketch of the supporting structure for clothes decoloration manufactured according to the integrated-mode semi-finished product shown in FIG. 3.

However, the above mentioned semi-finished product is not limited to leg-part-shaped mode, as shown in FIG. 3, it also can be the integrated mode of waist and leg (32). The semi-finished product (32) can have the structure shown in the figures and also have different structures from that shown in the figures. The texture of a certain shape (32*a*) is formed in the semi-finished product (32). At this time, the pair of semi-finished products (32) are placed opposite each other, and adhered with glue or by sewing or by using other methods along their length, to form the appropriate shape having a texture of a certain shape (40*a*) properly located in desired locations for aid the discolorization of garment at the appropriate locations. The semi finished parts may be used to form a supporting structure having the shape of an entire garment, such as a pair of pants 40 as shown in FIG. 4.

The texture formed on the above leg-part-shape semi-finished product (12) or (32) is as though it includes wrinkles. However, such texture is not limited to only wrinkles. It also can be the pattern of animal, plant, building, or words and Arabic numerals or line shapes.

Figure 5:
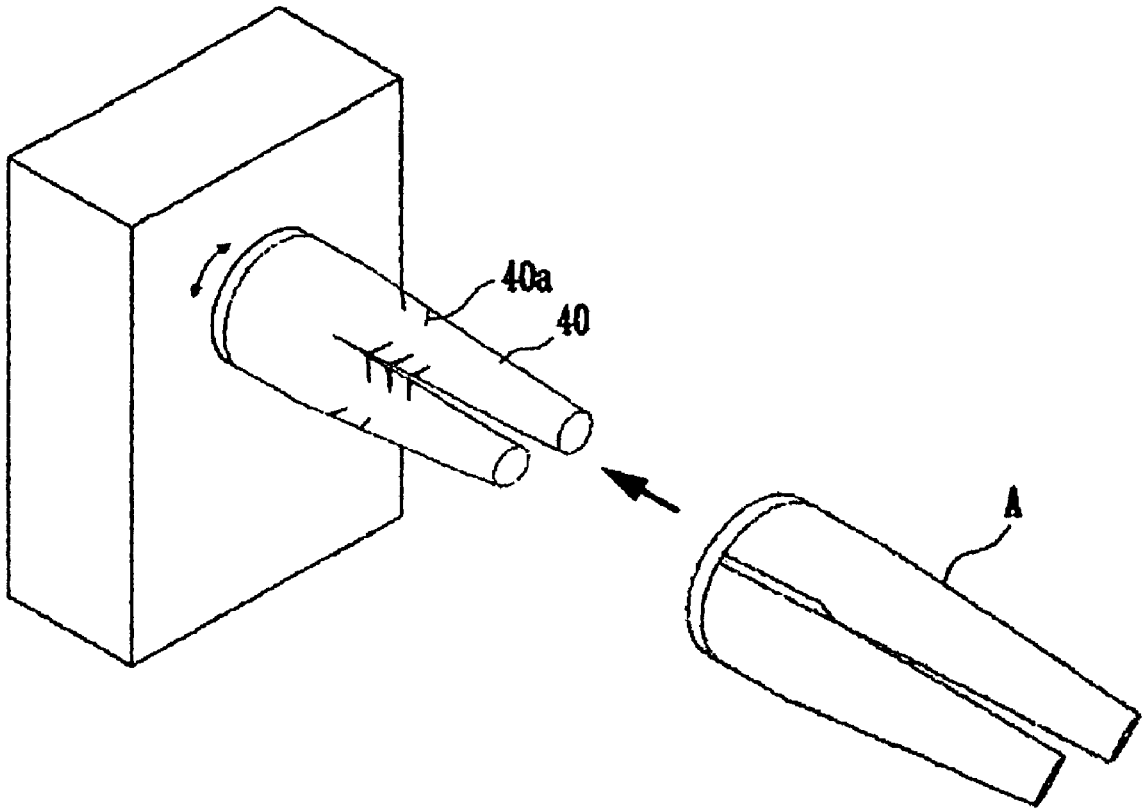
FIG. 5 is a sketch of a jean decoloration device installed with the supporting structure shown in FIG. 4 before the jeans are not put over it.

In the following, in reference of FIG. 2 and FIG. 5, the jean decoloration by the supporting structure of this invention after being installed in a jean decoloration device is explained.

The jean decoloration device as shown in FIG. 2 is not described herein as it is well known in the art. According to this invention, the supporting structure (20) for clothes to be decolorized is installed over each Cap (3) of the jean decoloration device. At this time, both ends of supporting structure (20) are fixed by clamping on Cap (3), as shown in FIG. 2. Additionally, compressed air from a compressor provided into the inner of supporting structure (20) through Cap (3) to keep the supporting structure (20) in an inflated expanded state.

After this, the leg part of a pair of jeans to be decolorized is slipped over the supporting structure (20) which is expanded (i.e., inflated). The pair of jeans are then rubbed with a grinding and/or abrasive tool like brush or sandpaper over textured portion of the supporting member to achieve decoloration having the same pattern as the textured surface of the supporting structure. As a result, the shape of the texture formed in supporting structure (20) appears directly on the surface of the cloth. In other words, by the application of trouser supporting structure (20) of this invention, the textures of same shape can be formed repeatedly at the same position.

The jean decoloration device as shown in FIG. 2 is not described herein as it is well known in the art. According to this invention, install the integrated-mode supporting structure (40) for clothes decoloration in the Cap at both ends of supporting point of above jean decoloration device. After covering its both ends, fix them with clamp. Additionally, provide compressed air from compressor into the inner of integrated-mode supporting structure (40) through the Cap to keep the integrated-mode supporting structure (40) on expanded state.

After this, the waist and leg part of a pair of jeans (A) is slipped over the expanded supporting structure (40*a*), according to the arrowhead direction. At this time, the concavo-convex part (40) (i.e., the textured surface) of waist and leg part of jean (A) appears according to the texture formed in integrated-mode supporting structure (40*a*). The concavo-convex part is rubbed with a device such as grinding and/or an abrasive tool like brush or sandpaper to achieve the decoloration of the jeans in accordance with the textured surface. As resulted, the texture formed in integrated-mode supporting structure (40) appears directly on the surface of the cloth (A). In other words, by the application of trouser supporting structure (40) of this invention, the textures of the same shape can be formed repeatedly at the same position.

Summing up the above, the operation method of this invention is explained by way of examples. The practitioner in the technical field can make modifications or improvements without deviating from the scope of this invention's purpose and summary. For example, in the above explanation, the decoloration is shown only with jeans by way of example. But this invention is not limited to jeans and it also can applied widely for the partial decoloration or rubbing treatment of jackets, trousers, or other types of clothes.

The invention claimed is:

1. A method for creating a worn pattern on clothing comprising:

creating a pattern on flexible material said pattern comprising at least one of a projection and a depression;

shaping said flexible material with said pattern to include at least a shape corresponding to a portion of said clothing, placing the clothing over said shaped flexible material with said pattern;

inflating said shaped flexible material with said pattern urging said pattern against said clothing; and rubbing said clothing with a device against the pattern for generating said worn pattern on said clothing in relief.

2. The method as recited in claim 1 wherein the clothing is a pair of jeans.

3. The method as recited in claim 1 wherein said flexible material is a material selected from the group of materials consisting of silicone, rubber, and neoprene nylon.

4. The method as recited in claim 1 wherein said pattern is pressed onto said flexible material.

5. The method as recited in claim 1 wherein said pattern is formed by applying pressure to said flexible material.

6. The method as recited in claim 1 wherein the device is selected from the group of devices consisting of brushes, sandpaper and grinding devices.

7. The method as recited in claim 1 wherein shaping comprises shaping said flexible material to a shape comprising at least a generally tubular portion.

8. The method as recited in claim 7 further comprising connecting said at least a generally tubular portion to an inflating device, and wherein inflating comprises inflating said at least a generally tubular portion.

9. The method as recited in claim 8 wherein connecting comprises connecting said at least a generally tubular portion to a cap of said inflating device.

10. The method as recited in claim 1 further comprising connecting said shaped flexible material to an inflating device.

11. The method as recited in claim 10 wherein connecting comprises connecting said flexible material to a cap of said inflating device.

* * * * *

UNITED STATES PATENT AND TRADEMARK OFFICE

CERTIFICATE OF CORRECTION

PATENT NO. : 8,122,575 B2
APPLICATION NO. : 12/242611
DATED : February 28, 2012
INVENTOR(S) : Joo Sik Kang It is certified that error appears in the above-identified patent and that said Letters Patent is hereby corrected as shown below:

In the Claims

Column 4, Claim 1, line 42. Delete "clothing,"
Insert -- clothing; --

Signed and Sealed this
Tenth Day of July, 2012

David J. Kappos

David J. Kappos
*Director of the United States Patent and Trademark Office*